United States Patent [19]

Hwang

[11] Patent Number: 4,507,945

[45] Date of Patent: Apr. 2, 1985

[54] QUINCUNX-SHAPED LOCK DEVICE

[76] Inventor: Shih M. Hwang, P.O. Box 7-369, Taipei, 106, Taiwan

[21] Appl. No.: 438,727

[22] Filed: Nov. 3, 1982

[51] Int. Cl.[3] ..... E05B 15/14; E05B 27/08

[52] U.S. Cl. ..... 70/363; 70/378; 70/419

[58] Field of Search ..... 70/363, 378, 392, 419, 70/416, 421

[56] References Cited

U.S. PATENT DOCUMENTS

| | | | |
|---|---|---|---|
| 565,622 | 8/1896 | Kennedy | 70/363 |
| 1,375,521 | 4/1921 | Lasky | 70/363 |
| 2,021,443 | 11/1935 | Deutsch | 70/363 |
| 4,078,405 | 3/1978 | Steinbach | 70/363 |

*Primary Examiner*—Robert L. Wolfe

*Attorney, Agent, or Firm*—Cushman, Darby and Cushman

[57] ABSTRACT

An improved quincunx-shaped lock device comprises a lower pin seat, a lower lock pin and a check ring. The whole lengths of the lower lock pins are different. The lengths of the pin head and pin tail having different outer diameters are also different. The bottom of the lower pin holes of the lower pin seat has pin-tail-through holes. The check ring is furnished with several irregular notches. Whenever the lower lock pins are pressed by a key other than that for the lock to the bottom of the lower pin holes, the pin tails will penetrate through the pin-tail-through hole, and some of them will touch the check ring, while others penetrate out of the notches of the check ring. Since numerous variations are designed in the lock, it is impossible to unlock it without the correct key.

2 Claims, 14 Drawing Figures

QUINCUNX-SHAPED LOCK DEVICE

BACKGROUND OF THE INVENTION

In the market, there are many kinds of locks. Since the quincunx-shaped lock has a special design offering a wide variation, it is usually used on motor-cycles, travel cases, alarm devices, the code control of electric apparatus, doors, cases, windows, and the like. In the said lock, an upper lock pin is provided on the upper pin seat, and a lower lock pin on the lower pin seat; by means of the key, the upper lock pins push the lower lock pins so as to turn the upper pin seat to unlock the lock. Unfortunately, a skilled locksmith or person will be able to unlock it by using a special tool to adjust the upper and lower lock pins to a correct position. In the present invention, the structure and the shape of the lower pin seat and the lower lock pins are specially designed to have the lower lock pins move in a longer space so as to make it impossible for a burglar to unlock it without the correct key because the lower lock pins cannot be adjusted to the correct position.

SUMMARY OF THE INVENTION

This invention relates to an improvement to the quincunx-shaped lock involving the lower pin seat, the lower lock pins and the check ring, particularly the lower pin seat and the lower lock pins. With the lower lock pins being pushed by the upper lock pins, the pin tails of the lower lock pins may penetrate through the lower pin seat through hole, or touch the check ring so as to give said lower lock pins more moving space. Anyone without the correct key will be unable to unlock it, thereby eliminating the drawback of the conventional quincunx-shaped lock being easily unlocked.

BRIEF DESCRIPTION OF THE DRAWINGS

FIG. 1-1 shows a right side view of the key end of said lock.

FIG. 7-1 shows the right side view of a key of the present invention.

FIG. 11-1 shows a plane view of various lower lock pins in the present invention.

DETAILED DESCRIPTION

Figure 1:
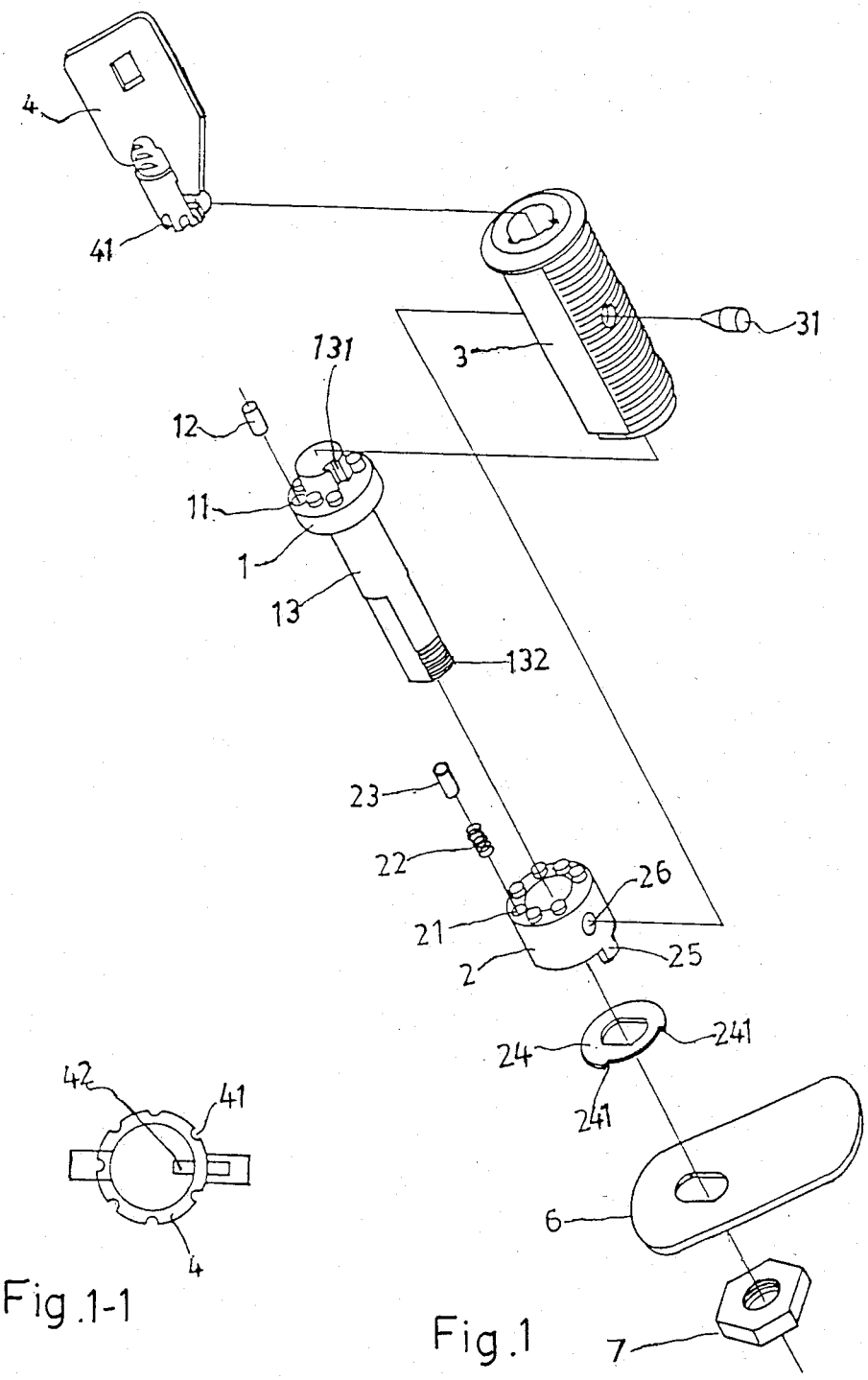
FIG. 1 shows on exploded view of a conventional quincunx-shaped lock.

First, a conventional quincunx-shaped lock is described as follows: Referring to FIG. 1, where is shown an exploded view of a conventional quincunx-shaped lock, in which the upper pin seat (1) is fixed to the rotary shaft (13); in the upper pin hole (11) of the upper pin seat (1), there are several upper lock pins (12) in different lengths, and in the lower pin hole (21) of the lower pin seat (2), there are springs (22) and several lower lock pins (23) in the same length; the rotary shaft (13) goes through the lower pin seat (2) and the check ring (24), to let every upper lock pin (12) align with each corresponding lower lock pin (23), which will be inserted into the upper pin hole (11) of the upper pin seat (1) upon being pushed by the springs (22); then, the upper and lower pin seats (1 and 2) are assembled into the outer case (3), and are fixed with a fixing pin (31) through the outer case (3) to the fixing hole (26) of the lower pin seat (2), so that the lower pin seat (2) is fixed to the outer case (3) as an one-piece structure.

Figure 2:
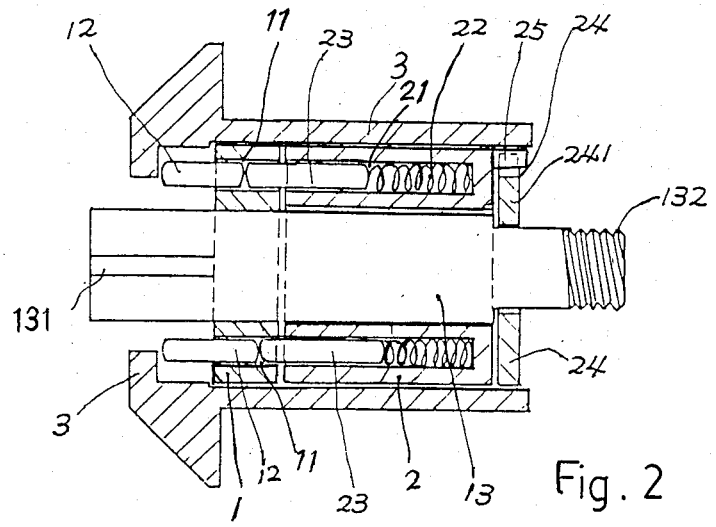
FIG. 2 shows the sectional view of a conventional quincunx-shaped lock.

Referring to FIG. 2, where is shown the upper and lower pin seats (1 and 2) being placed inside the outer case (3), the upper lock pins (12) come in contact with a flange having a smaller diameter at the head of the outer case (3). Since the lower pin seat (2) is fixed to the outer case (3), and the lower lock pins (23) are inserted into the upper pin holes (11) of the upper pin seat (1), the upper pin seat (1) can be rotated in both directions only when all of the upper lock pins (12) have been pushed to an appropriate position.

Referring again to FIG. 1, the rotary shaft (13) is designed to go through the lower pin seat (2), the check ring (24), and the latch (6), with its threaded portion (132) screwing through a nut (7). The upper pin seat (1) must be rotated first before turning the latch (6). In the key (4) of said lock, a rotary stud (42) is provided in the inner hollow portion as shown in FIG. 1-1, and it is designed to insert into the rotary slot (131) at the front end of the rotary shaft (13). Further, on the key (4), there are a given number of pin-pushing slots (41) having different depths, which are used for rotating the upper pin seat (1).

Figure 3:
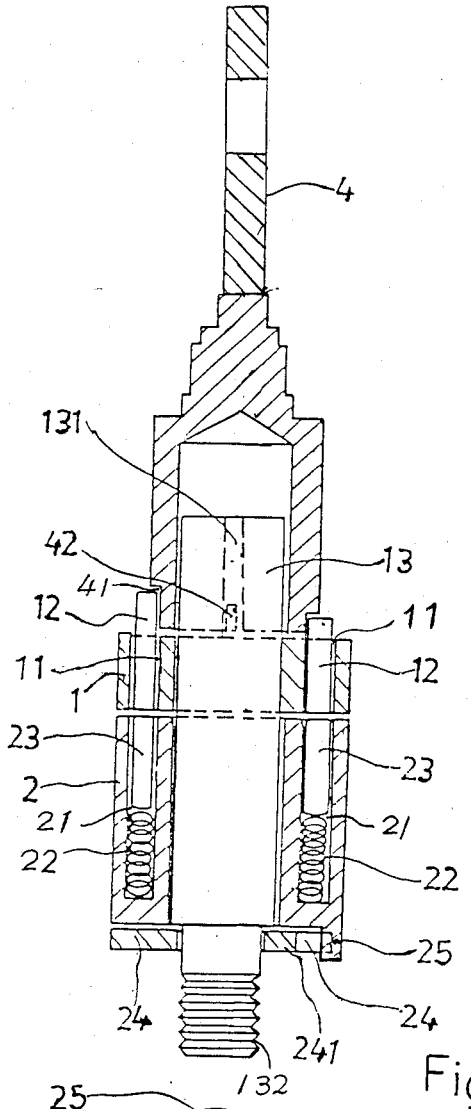
FIG. 3 shows the sectional view of a conventional quincunx-shaped lock being inserted with its key.

Referring to FIG. 3, the key (4), having been inserted into the outer case (3), pushes all the upper lock pins (12) to such an extent that all the lower lock pins (23) are pushed back to the lower pin holes (21), while no upper lock pin (12) is inserted into the lower pin hole (21). Now, with the rotary stud (42) in the rotary slot (131), as the key (4) is further turned, the upper pin seat (1) will rotate to actuate the latch (6) to the same direction to unlock the lock.

Figure 4:
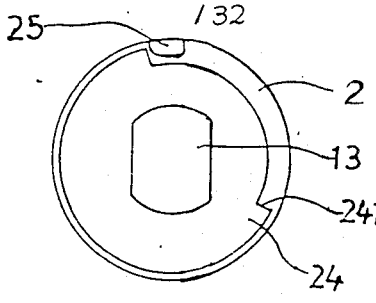
FIG. 4 shows the side view of check ring of conventional quincunx-shaped lock.

FIG. 4. Shows the end view of said conventional quincunx-shaped lock. As the rotary shaft (13) is turned by the key (4) to unlock or lock the quincunx-shaped lock, it will drive the check ring (24) to rotate. When the wide check notch (241) of the check ring (24) touches the stud (25) of the lower pin seat (2), it will be stopped by the stud (25) so as to prevent the key (4) from turning a big angle that is not desired.

Figure 5:
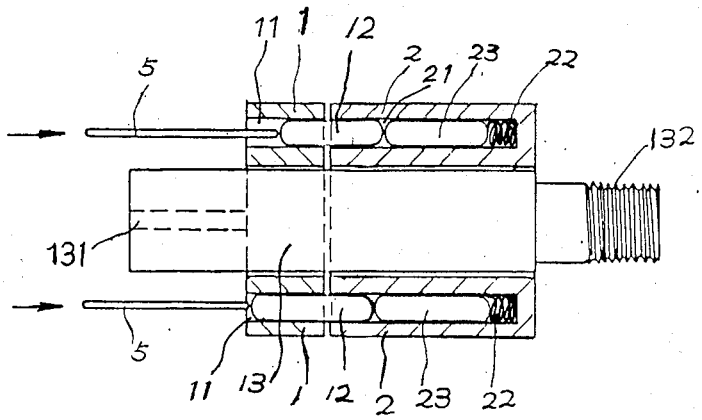
FIG. 5 shows view No. 1 of a conventional quincunx-shaped lock being unlocked with steel pins.

FIG. 5. Shows several steel pins (5) inserted into the upper pin holes (11) to push the upper lock pins (12) so as to press the lower lock pins (23) to the rear end of the lower pin holes (21). Then, by pulling out all the steel pins (5) simultaneously, and by trying to probe and turn the upper pin seat (1) with said steel pins (5) while the springs (22) push the lower lock pins (23) and the upper lock pins (12) backward until the lower lock pins (23) reach to a correct position as shown in FIG. 6, the upper pin seat (1) may then be turned, and the latch (6) will also be turned to unlock the lock.

Figure 6:
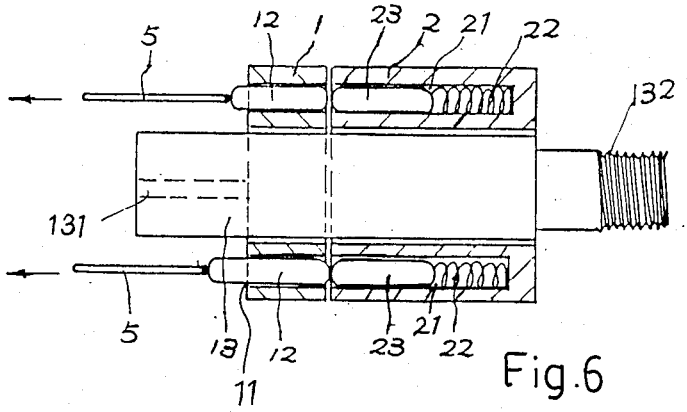
FIG. 6 shows view No. 2 of a conventional quincunx-shaped lock being unlocked with steel pins.

According to the unlocking steps shown in FIG. 5 and 6, the conventional quincunx-shaped lock may easily be unlocked; in other words, said conventional quincunx-shaped lock gives more opportunities of breaking the intended protection to burglars and any one who knows locks.

In veiw of the aforesaid facts, the inventor has, through repeated studies, developed an improved quincunx-shaped lock so as to eliminate the drawbacks of the conventional quincunx-shaped lock.

Figures 1, 7:
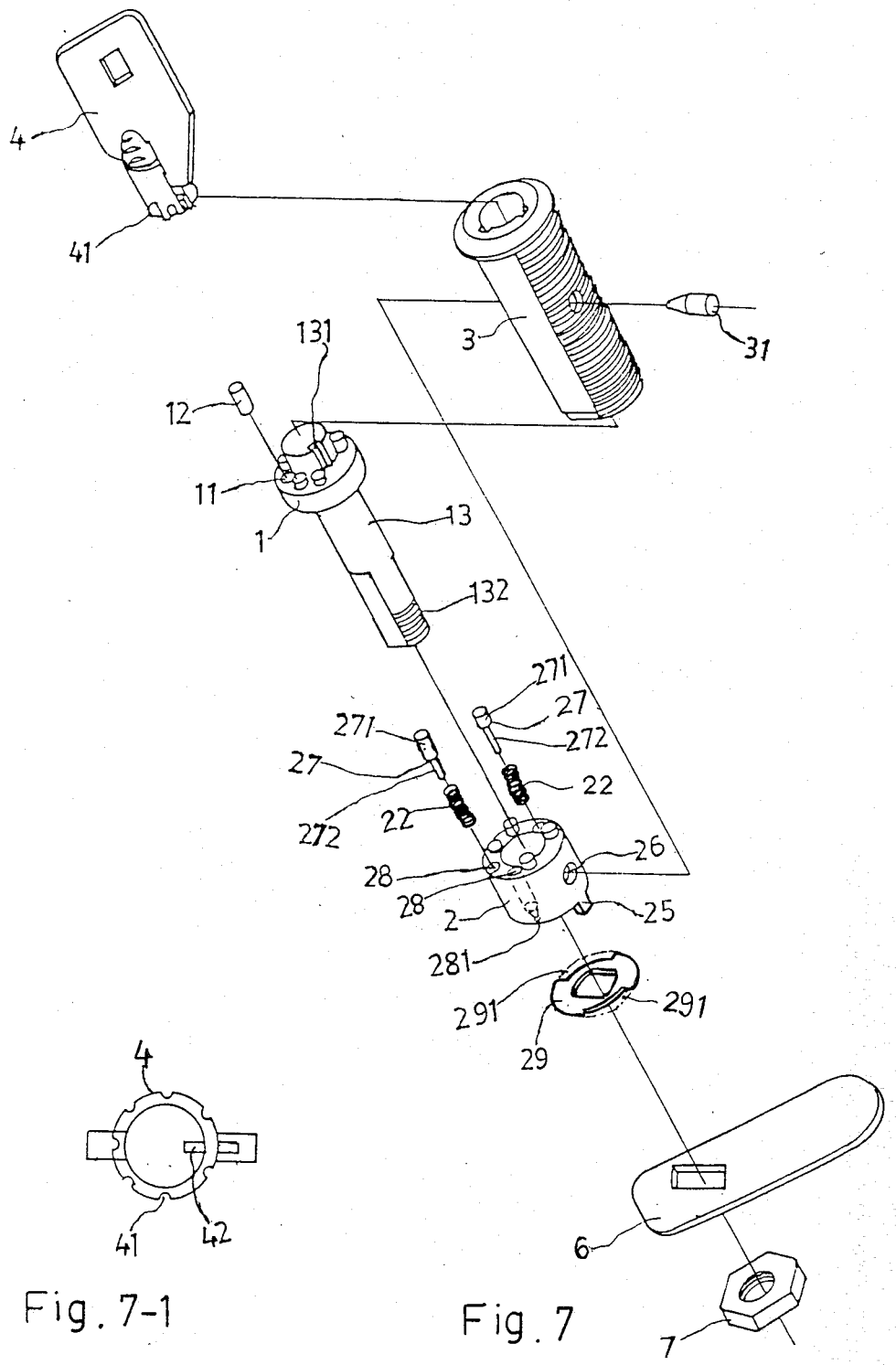
FIG. 7 shows an exploded view of a quincunx-shaped lock in the present invention.

The structure and the function of the present invention are described in detail as follows:

FIG. 7. Shows an exploded view of the quincunx-shaped lock in the present invention. In fact, the improved parts of the present invention are limited to the lower pin seat (2), the lower lock pin (27) and the check ring (29), while the remaining parts are the same as those of the conventional quincunx-shaped lock.

Referring to FIG. 7-1, where is shown a key (4) having a hollow space in the middle and having a rotary stud (42) and also having several pin-pushing slots (41) of varying depths around the key (4). In the following description, only the improved parts of the quincunx-shaped lock are covered.

Figure 10:
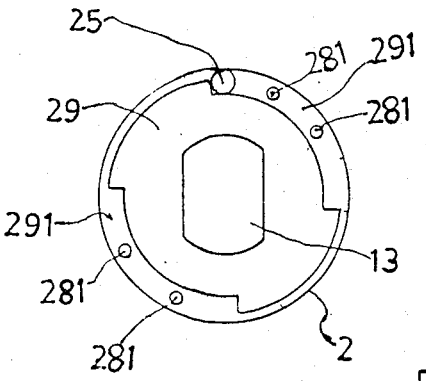
FIG. 10 shows a side view of said quincunx-shaped lock.

Referring to FIG. 7, there is shown an improved quincunx-shaped lock of which the improved parts inlucde the lower pin seat (2), the lower lock pin (27), and the check ring (29). The features are that pin-tail-through holes (281) are provided at the bottom of the lower pin holes (28) of the lower pin seat (2) for pin tails to go through, and each lower lock pin (27) has a large-diameter pin head (271) with a small-diameter pin tail (272). Further, the whole length of each lower lock pin (27) and the lengths of both the pin head (271) and the pin tail (271) are variable so as to match the springs (22) of varying lengths. As the lower lock pin (27) is inserted into the lower pin hole (28), the pin tail (272) will penetrate through the pin-tail-through hole (281). Further, the check ring (29) of the present invention is furnished with several irregular notches (291), as shown in FIG. 10, so as to prevent some of the pin tails (272) of the lower lock pins (27) from penetrating out through the pin-tail-through holes (281), or to let said pin tail (272) penetrate out of the notch (291) so as to allow the lower lock pins (27) longer moving space in the lower pin holes (28). Under such a condition, it would be very difficult to find the appropriate position of the lower lock pins (27) without using the correct key (4); therefore, it would be very difficult to unlock the lock.

Figure 8:
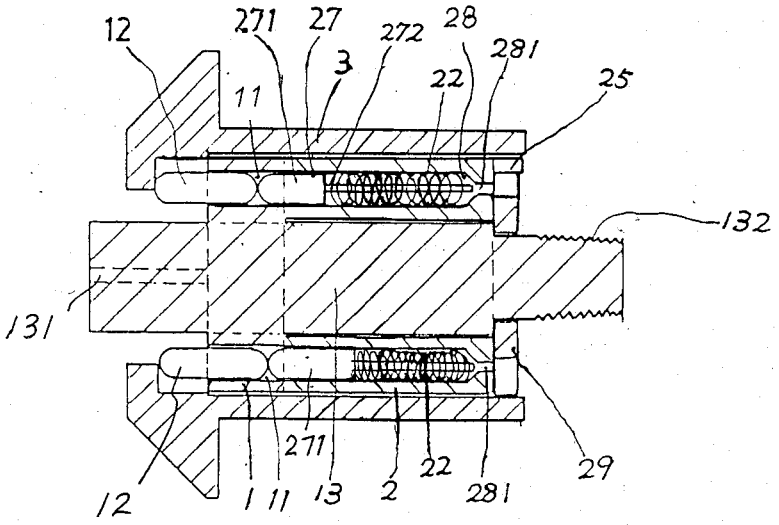
FIG. 8 shows a sectional view of a quincunx-shaped lock in the present invention.
Figure 11:
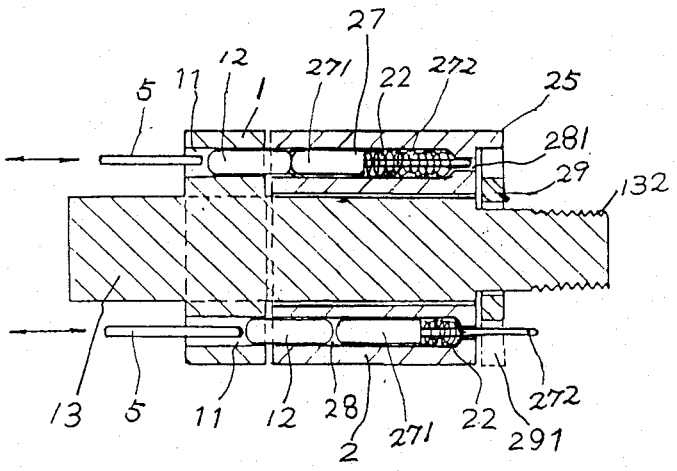
FIG. 11 shows a quincunx-shaped lock in the present invention which cannot be unlocked with a steel pin.
Figures 1, 11:
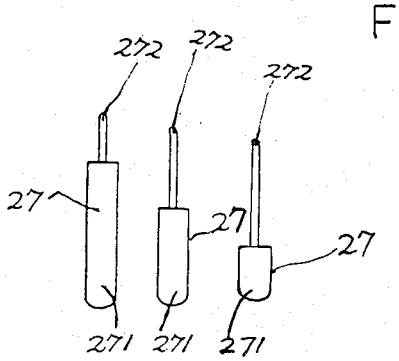

FIG. 8. Shows a sectional view of the quincunx-shaped lock of the present invention, which indicates that said improved quincunx-shaped lock can only be unlocked when the contact position of the upper lock pin (12) and the lower lock pin (27) just corresponds to the contact position of the upper pin seat (1)and the lower pin seat (2), which then allows the upper pin seat (1) to be rotated.

Figure 9:
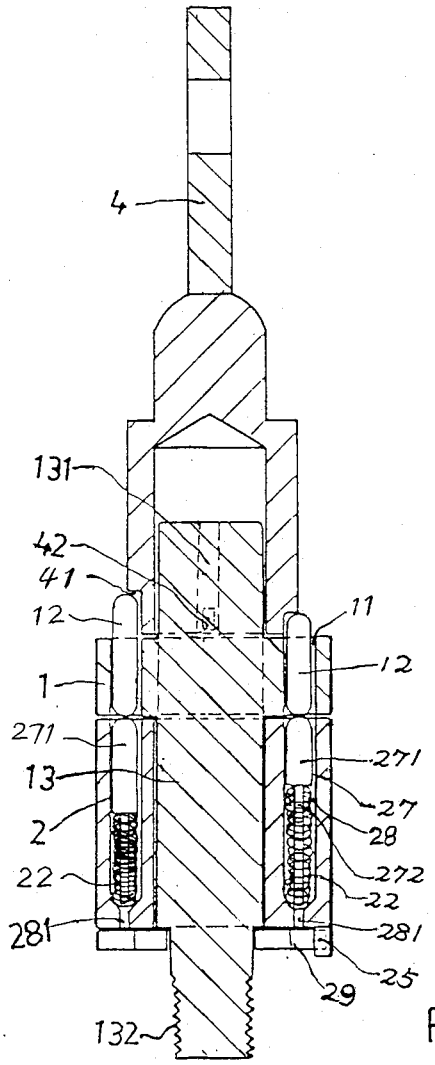
FIG. 9 shows a sectional view of said quincunx-shaped lock being inserted with its key.

FIG. 9. Shows a sectional view of the key (4) unlocking the lock of the present invention.

Again, referring to FIG. 5, there it is shown a burglar trying to unlock the present invention by inserting several steel pins (5) individually into the upper pin holes (11) and pushing the upper lock pins (12) and the lower lock pins (27).

In unlocking the conventional lock, one has to push the lower lock pins (27) to the bottom of the lower pin holes (28) and then slowly pull out the steel pins (5) simultaneously. However, in pushing the lower lock pins (27) of the present invention with the same steel pins (5), some phenomena will take place; i.e.

(a) the pin tails (272) of some of the lower lock pins (27) will touch the check ring (29), and will be unable to penetrate out of the irregular notches (291) of the said check ring (29).

(b) since the lengths of the pin heads (271) and the pin tails (272) of said lower lock pins (27) differ from one another, and the whole lengths of the lower lock pins (27) themselves also vary (shown in FIG. 5-1), it is impossible to find out where the correct positions of the lower lock pins (27) are to unlock the lock as the pin tails (272) of the some of lower lock pins (27) touch the check ring (29);

(c) the pin tails (272) of some of the lower lock pins (27) may either penetrate through the pin-tail-through holes (281) or penetrate out of the irregular notches (291) of the check ring (29); as a result, it is impossible to push all the lower lock pins (27) completely to the bottom of the lower pin holes (28);

(d) since the lengths of the pin heads (271) and the pin tails (272) of said lower lock pins (27) are different, and when the pin tails (272) of the lower lock pins (27) penetrate through the pin-tail-through holes (281) and the irregular notches (291) of the check ring (29), the length of each pin head (271) is still different; therefore, it is still impossible to find the correct position of the lower lock pins (27).

According to the aforesaid four phenomena, even an expert in locks will be unable to unlock the present invention by means of a tool other than the original key (4). Naturally, a burglar without the original key (4) would also find it impossible to unlock the present invention.

Referring again to FIG. 7, where is shown the rotary shaft (13) being fixed to the latch (6) after penetrating through the lower pin seat (2) and the check ring (29). The present invention may also be used as an electronic lock by merely changing the latch (6) into a copper bar to trigger a circuit; then, the lock can be operated as an electronic lock.

I claim:

1. An improved quincunx-shaped lock device comprising a lower pin seat, said lower pin seat having a plurality of lower pin holes therein, a plurality of lower lock pins springingly disposed in a respective said lower lock pin hole, the number of said lower lock pins corresponding in number to the number of said lower pin holes, said lower lock pins each including a pin head and a pin tail, each said lower lock pin having a differing length and differing cross-sectional diameter, the lower pin holes in said lower pin seat being furnished with pin-tail-through holes, a check ring, said check ring having notches therein such that when said lower lock pins are pushed downwardly, said pin tails penetrate either through just the pin-tail-through holes or through the notches in said check ring, while some of said pin tails touch said check ring and stop there.

2. An improved quincunx-shaped lock device consisting essentially of a rotary shaft having a longitudinal axis extending between front and rear ends thereof, an upper pin seat rotably and forwardly mounted on said shaft, said pin seat having upper end holes therein, upper lock pins disposed in said upper pin holes, a lower pin seat rotably and rearwardly mounted on said rotary shaft, a notched check ring mounted rearward of said lower pin seat, a plurality of lower lock pins, each said lower lock pin having a different length and a different cross-sectional diameter, each said pin having a pin tail, each said pin tail having a different length and different cross-section diameter, said lower pin seat having a plurality of lower pin holes therein, the number of said pin holes corresponding in number to the number of said lower lock pins, said lower pin holes each having a pin-tail-through hole, a spring disposed in each said lower pin hole, each said lower lock pin disposed in a corresponding said lower pin hole wherein each said pin-tail of each said lower pin engages a said spring, such that when each upper lock pin aligns with a like corresponding spring forwardly and into an upper pin hole in said upper pin seat, said upper pins having front ends engageable with a key, whereby rotably and rearwardly movement of the key then rearwardly moves said upper pins in said upper pin holes to push a respective said lower pin rearwardly until each said pin tail penetrates either through each pin-tail-through hole and touches said check ring and stops or extends through a pin-tail-through hole and through said notched check ring, and an outer case sliding over and enveloping said rotary shaft and the aforesaid components mounted thereon, said outer case having a fixing pin aperature therein and a fixing pin extending through said aperature, said fixing pin engaging said lower pin seat to thereby fix said outer case to said lower pin seat.

* * * * *